US010472772B2

(12) United States Patent
Gnaczynski et al.

(10) Patent No.: US 10,472,772 B2
(45) Date of Patent: Nov. 12, 2019

(54) SYSTEM AND FASTENING POINT FOR SCREWLESS FASTENING OF A RAIL FOR A RAIL VEHICLE

(71) Applicant: Vossloh-Werke GmbH, Werdohl (DE)

(72) Inventors: Martin Gnaczynski, Plettenberg (DE); Adrian Bednarczyk, Ludenscheid (DE)

(73) Assignee: Vossloh-Werke GmbH, Werdohl (DE)

( * ) Notice: Subject to any disclaimer, the term of this patent is extended or adjusted under 35 U.S.C. 154(b) by 58 days.

(21) Appl. No.: 15/761,489

(22) PCT Filed: Aug. 31, 2016

(86) PCT No.: PCT/EP2016/070471
§ 371 (c)(1),
(2) Date: Mar. 20, 2018

(87) PCT Pub. No.: WO2017/054998
PCT Pub. Date: Apr. 6, 2017

(65) Prior Publication Data
US 2018/0274177 A1 Sep. 27, 2018

(30) Foreign Application Priority Data
Sep. 28, 2015 (DE) ..... 10 2015 116 345

(51) Int. Cl.
*E01B 9/62* (2006.01)
*E01B 9/34* (2006.01)
(Continued)

(52) U.S. Cl.
CPC ..... *E01B 9/62* (2013.01); *E01B 9/303* (2013.01); *E01B 9/483* (2013.01); *E01B 9/60* (2013.01);
(Continued)

(58) Field of Classification Search
CPC ... E01B 9/34; E01B 9/483; E01B 9/32; E01B 2201/00; E01B 2205/00; E01B 29/24; E01B 9/303; E01B 9/60; E01B 9/62
See application file for complete search history.

(56) References Cited

U.S. PATENT DOCUMENTS 2,980,336 A * 4/1961 Doll ..... E01B 9/303 238/304
3,338,521 A * 8/1967 Sanson ..... E01B 9/303 238/349
(Continued)

FOREIGN PATENT DOCUMENTS

DE 2649527 C2 5/1977
GB 861473 A 2/1961
(Continued)

*Primary Examiner* — Mark T Le
(74) *Attorney, Agent, or Firm* — The Webb Law Firm

(57) ABSTRACT

A system for a screwless rail fastening includes a spring element and a supporting collar. The spring element has a bearing section, a curved section, a holding-down section, aligned in the opposite direction to the bearing section, a curved section curved in the direction of the bearing section, and a locking section aligned transversally to the bearing section. The supporting collar includes a fastening section for retaining the supporting collar on the foundation, a carrier section supported by the fastening section, a bearing recess formed on the carrier section for mounting of the bearing section, and a locking head supported by the carrier section on which a counter-bearing for the locking section is formed so that the locking section is retained in a position relative to the bearing section of the spring element.

15 Claims, 6 Drawing Sheets

(51) Int. Cl.

| | |
|---|---|
| ***E01B 9/30*** | (2006.01) |
| ***E01B 9/48*** | (2006.01) |
| ***E01B 9/60*** | (2006.01) |
| ***E01B 29/24*** | (2006.01) |

(52) U.S. Cl.
CPC ..... *E01B 29/24* (2013.01); *E01B 9/34* (2013.01); *E01B 2201/00* (2013.01); *E01B 2205/00* (2013.01)

(56) References Cited

U.S. PATENT DOCUMENTS 4,073,435 A 2/1978 Miller
4,119,271 A * 10/1978 Campbell ..... E01B 9/483 238/292
4,150,791 A * 4/1979 Reynolds ..... E01B 9/483 238/282
4,304,359 A * 12/1981 Fischer ..... E01B 9/303 238/349
4,316,578 A * 2/1982 Reynolds ..... E01B 9/483 238/264
4,325,510 A * 4/1982 Sherrick ..... E01B 9/66 238/282
4,625,912 A * 12/1986 Fee ..... E01B 9/303 238/338
4,953,787 A * 9/1990 Fee ..... E01B 9/12 238/338
4,967,954 A 11/1990 von Lange
5,221,044 A * 6/1993 Guins ..... E01B 9/483 238/297

FOREIGN PATENT DOCUMENTS

GB 2062071 A 5/1981
GB 2085057 A 4/1982
KR 1020140109039 A 9/2014
WO 2005116339 A1 12/2005
WO 2014177835 A1 11/2014

* cited by examiner

SYSTEM AND FASTENING POINT FOR SCREWLESS FASTENING OF A RAIL FOR A RAIL VEHICLE

CROSS-REFERENCE TO RELATED APPLICATIONS

This application is the United States national phase of International Application No. PCT/EP2016/070471 filed Aug. 31, 2016, and claims priority to German Patent Application No. 10 2015 116 345.4 filed Sep. 28, 2015, the disclosures of which are hereby incorporated in their entirety by reference.

BACKGROUND OF THE INVENTION

Field of the Invention

The invention relates to a system and a fastening point constituted by such a system for the fastening of a rail for rail vehicles. To this end an object of the invention is a system and a fastening point, allowing what is known as a "screwless" fastening of rails for rail vehicles.

In this connection, "screwless" means that in systems and fastening points of the type involved here the spring element provided to hold down the rail on the foundation is clamped without the help of separate clamping devices, such as screws, wedges, pins and the like.

On the other hand, such devices, in the sense of fastening means, can for example be used to anchor individual system components or the fastening point to the foundation.

The rails to be fastened according to the invention are conventional railway tracks as normally used in long distance, local or urban transport services. These normally one-piece rails have a railhead, the free top side of which constitutes the running surface for the wheels of the rail vehicle, a web, supporting the railhead, and a foot, on which the web is positioned and which protrudes on either side of the web, in order to guarantee a sufficiently broad support surface for support without tilting.

Screwless rail fastenings of the type involved here are based on the concept of anchoring a suitable support element in the respective foundation supporting the rail fastening point and clamping a spring element on this support element in such a way that it exerts an elastic load on the rail to be fastened. The interacting components of the system or fastening point are designed here so that the spring element is held in its active position without further components being necessary. In order for this to happen, the support element generally has a fastening section, which is embedded in the foundation, and a carrier section, on which form elements are formed, which serve as stops or supports for the clamping of the spring element. Here the spring element is formed in such a way that when secured to the respective form elements it is twisted or bent so that it exerts a springy, elastic compressive force in the direction of the foundation on the rail foot. In order to be able to apply the maximum spring forces, the spring elements of screwless rail fastening points are to this end normally bent under continuous smooth traction from a wire made of spring steel.

Description of Related Art

Examples of screwless fastenings of rails for rail vehicles of the type involved here are described in WO 2014/177835 A1. As mentioned there, such rail fastenings have been known for a long time and in many variants (GB 861473 A, DE 2649527 C2, GB 2085057 B).

SUMMARY OF THE INVENTION

Against the background of the prior art explained above, an object is to provide a system for a screwless rail fastening and a correspondingly designed fastening point for a rail for rail vehicles, that can be easily assembled and at the same time also guarantee optimum safe fastening under maximum loading and tough operating conditions.

Advantageous embodiments of the invention are explained in detail in the following together with the general inventive concept.

A system according to the invention for screwless fastening of a rail for a rail vehicle on a foundation thus includes a spring element and a supporting collar. The spring element is bent from a spring wire and starting from its one end successively has a bearing section, a first curved section, connected to the bearing section, a holding-down section, connected to the first curved section and aligned in the opposite direction to the bearing section, wherein the holding-down section is intended, when in use, to rest on an upper surface of a foot of the rail to be fastened, a second curved section, connected to the holding-down section and curved in the direction of the bearing section and a locking section, connected to the second curved section and aligned transversally to the bearing section, wherein at least when the spring element is unassembled seen from the side there is a distance between the holding-down section and the locking section. The supporting collar has a fastening section, via which the supporting collar is secured to the foundation when the system is fully assembled, a carrier section supported by the fastening section, a bearing recess formed on the carrier section, in which, when the system is fully assembled, the bearing section of the spring element is pivot-mounted, and a locking head supported by the carrier section, on which the counter-bearing for the locking section of the spring element is formed such that when the system is fully assembled the locking section is held in a position relative to the bearing section of the spring element in which the spring element is clamped in a springy elastic manner between the bearing recess and the counter-bearing of the supporting collar and the holding-down section acts in a springy elastic manner on the surface of the rail foot associated with it.

In a system according to the invention for fastening a rail for rail vehicles and a correspondingly designed fastening point the spring element and supporting collar are coordinated so that the clamping of the spring element is enabled by pivoting about the pivot axis defined by the bearing seat of the supporting collar.

To this end the spring element formed from a spring wire in a single pass, e.g. as one piece and in a continuous, smooth process, is provided with a bearing section, which because of its arrangement on one end of the spring element like an axle stub is inserted in the bearing seat and supported there with sufficient play for the spring element to be rotated without problems in the bearing seat about the longitudinal axis of the bearing section then coinciding with the pivot axis of the bearing seat.

At the same time, on the other end of the spring element a separate locking section is formed, via which during assembly the spring element is latched to a locking head formed on the supporting collar. In the fully assembled state the locking head then forms a counter-bearing for the spring element, which simultaneously with its holding-down section is supported by the foot of the rail and accordingly exerts the necessary elastic load on the holding-down section, as a result of which the rail is elastically and flexibly retained on the foundation.

For the clamping and fastening of spring element on the respective foundation, with a system according to the invention basically only one component, namely the supporting collar, is necessary, the shape of which is selected to coordinate with the shape of the spring element so that assembly and disassembly of the spring element can be brought about by a simple pivoting movement. At the same time, it allows the clamping according to the invention of the spring element to apply high holding-down forces, with simultaneous maximised elasticity of the bearing, via the bearing seat, the locking head and the contact area on the rail foot counter-bearings.

Regarding a spring element provided in a system or fastening point according to the invention:

In the following description of the features of a spring element according to the invention, starting from the free end of the bearing section the curve described in full by the spring element is followed, wherein this curve can of course comprise sections with a linear design.

Considered on its own, e.g. independently of the other components of a system or fastening point according to the invention, in particular, however, in combination with other components of a system or fastening point in accordance with the invention, a spring element designed according to the invention is characterised in that it is formed by bending a spring steel wire and thereby has at least one bearing section, one holding-down section and one locking section, wherein the bearing section is connected via a first curved section with the holding-down section and the holding-down section via a second curved section with the locking section.

The bearing section starts from one end of the spring element and serves to support the spring element in the bearing seat of the supporting collar. Optimum pivoting and mounting capability can be guaranteed here in that at least sections of the bearing section have a linear design. In particular in the case where the bearing seat is a circular through opening, with regard to mounting capability it is advantageous if the bearing section has a fully linear form. It can then be coupled into the bearing seat by simply inserting it like a pin.

The first curved section connecting to the bearing section is bent in such a way that the holding-down section connected to it is aligned in the opposite direction to the bearing section, e.g. with its end turned away from the first curved section pointing in a direction which is opposite the direction in which the end associated with the first curved section points. Accordingly, the first curved section of a spring element according to the invention regularly describes a curve of more than 90°, in particular up to 180°, wherein this does not of course require there to be a continuously curved line, but also allows for one or more sections of the curve to have a linear design. It is essential that the first curved section is formed in such a way that the holding-down section starting from it is aligned in the opposite direction to the bearing section. The first curved section can also be domed, and thus not just when the spring element is seen from above, but also when seen from the side, it can describe a bend starting from the bearing section, which, when the bearing section is seated in the bearing seat of the supporting collar associated with it and the spring is fully assembled, is raised above the foundation. As a result of this design the fatigue strength and the elastic flexibility of the spring element can be further optimised with minimal space requirements.

In the spring element according to the invention a holding-down section is connected to the first curved section. In the fully assembled system or fastening point, this holding-down section is supported by the top side associated with it of the foot of the rail to be fastened. Accordingly, when in use the spring element exerts the elastic compressive force on the holding-down section, as a result of which the rail is kept pressed against the foundation. Here the holding-down section can essentially have any shape that guarantees a permanently secure transfer of the load to the rail foot. For example, a bent design matched to the shape of the rail foot is conceivable, if for example the holding-down section has to extend as far as possible across the rail foot in order to compensate for tolerances. It has proven particularly convenient here, in particular also with regard to optimum effectiveness of the holding-down force, if the holding-down section has a linear form. The linear form allows the holding-down section to be attached parallel to the longitudinal edge and in the near vicinity of this edge on the periphery of the rail foot, so that an optimum leverage effect in relation to the rail head is achieved.

At the same time such a linear design allows simple fastening of an insulating element to the holding-down section. Such an insulating element manufactured in a known fashion from an electrically non-conducting material can, in a similarly in itself known fashion, be attached in particular in a detachable manner, for example by means of a clip or push-on fitting, to the holding-down section and serves to electrically insulate the components of the fastening point from the rail. The advantage of fastening the insulating element to the holding-down section of the spring element is that the spring element can then take the insulating element with it when the spring element pivots about the pivot axis of the bearing seat of the supporting collar, until it is positioned between the associated top side of the foot of the rail and the holding-down section of the spring element. In this way, the insulating element can thus be pre-assembled so that it stays in place on the spring element.

In a spring element according to the invention, a second curved section is connected to the holding-down section. This is bent in the direction of the bearing section and so that when the spring element is seen from above the locking section connected to it is aligned transversally to the bearing section. The second curved section thus delimits a curve of more than 180°, irrespective of whether it forms a continuous curve or is made up of two or more curves punctuated by one or more linear sections. At the same time, the second curved section can also be domed just like the first curved section and for the same purpose, so that seen from the side they describe a bend starting from the holding-down section, which, if the holding-down section is seated on the top side of the rail foot associated with it and the spring element is fully assembled, is raised above the foundation. With regard to the compactness of the construction or the uniformity of the force transmission it has proven advantageous here if the dome of the second curved section has the same height as the dome of the first curved section.

The second curved section merges into the locking section of the spring element according to the invention. When in use this is in contact with the locking head of the supporting collar. Its arrangement here on the end of the spring element and of the second curve turned away from the bearing section, allows during assembly and disassembly a tool to be applied to the locking section and the spring element to be easily deformed so that it latches in the position of use or is released from this. In the position of use, the locking section is then retained securely on the locking head, without special safeguards being necessary for this. It has proven particularly advantageous with regard to the assembly and disassembly capability and secure seating in the counter-bearing formed by the locking head, if the locking section has a linear design.

With regard to the compactness of a spring element according to the invention it has proven advantageous if, when the spring element is seen from above, its bearing section and holding-down section are aligned axially parallel to one another and its locking section at right angles thereto.

Another particularly beneficial embodiment of the spring element according to the invention for certain practical applications consists in that the length of the locking section is dimensioned so that when the spring element is seen from above, the locking section projects over the holding-down section of the spring element. In this configuration, the end section of the locking section secured to the locking head freely projecting when in use over the holding-down section serves as a height stop, that prevents the rail and, with it, the holding-down section of the spring element sitting on it, from displacing too far from the foundation in the vertical direction.

In practice, the foundation, on which a fastening point according to the invention is arranged, is formed by a sleeper or slab, which is for example made from concrete or a similar flowable and hardenable substance. In the specific case where the foundation is a sleeper, this is typically supported by a ballast bed consisting of coarse and densely-packed gravel stones.

The design according to the invention of the spring element allows an altogether compact construction, in which in particular the curve sections arranged closely adjacent to one another form a kind of cage around the locking head of the supporting collar. This cage protects the locking head from damage from hard pieces of gravel or similar, which may be stirred up when a sleeper forming the foundation is supported on a gravel bed and a rail vehicle travels over the rail, or when the gravel bed is being packed with gravel.

Regarding a supporting collar provided in a system or fastening point according to the invention:

In a system according to the invention or a fastening point according to the invention, the supporting collar serves to secure the components of the respective system or fastening point to the foundation.

To this end, the supporting collar has a fastening section. This is typically designed like a blade or mandrel and embedded in the respective foundation. Where the foundation is, for example, a sleeper or slab made from a concrete material or a similar flowable and hardenable substance, this can be achieved by the fastening section being cast in the foundation.

The fastening section supports a carrier section of the supporting collar. This carrier section first and foremost absorbs the load exerted on or taken up by the supporting collar. The carrier section is therefore advantageously designed so that in addition to the anchoring it is supported over a comparably large area on the surface of the foundation.

On the carrier section the bearing section is formed, in which, when the system is fully assembled, the bearing section of the spring element is pivot-mounted to pivot about a pivot axis. To this end, the bearing recess typically has a circular section and can for example be designed as a through opening, in which the in this case optimally linearly and pin-like designed bearing section of the spring element is inserted. It is also conceivable, however, for the bearing recess to be designed so that when the system or fastening point is fully assembled it encompasses the bearing section only in sections to the extent that pivoting of the spring element in the pivot bearing formed by the bearing recess is possible. To this end it can be sufficient if the bearing recess encompasses the bearing section by more than 180°.

A further important design feature of a supporting collar according to the invention is the locking head supported by the carrier section. The locking section of the spring element is attached to this when assembling a fastening point according to the invention so that the spring element which is then clamped between the bearing seat and the counter-bearing on the locking head through its holding-down section exerts a sufficiently springy elastic load on the rail foot.

Optimally the dimensions and the design of the locking head are selected so that during assembly of a fastening point according to the invention the locking head can be passed through an interstice delimited by the spring element. In this way, when the rail fastening point according to the invention is fully assembled, the locking head can for example sit in this interstice, around which an end section of the holding-down section, the second curved section and the locking section of the spring element revolves. This type of arrangement of the locking head in an interstice delimited by the spring element has the advantage that the spring element protects the comparatively delicate locking head from damage by stones and similar that fly up, because the stones do not come into contact with the locking head, but bounce off the sturdy spring steel material of the spring element.

The counter-bearing of the supporting collar provided on the locking head as a stop for the locking section of the spring element is designed as a latching projection, protruding in a direction aligned parallel to the pivot axis of the locking head. This configuration has proven to be particularly convenient if the locking section when seen from above is aligned at right angles to the bearing section of the spring element.

Here the assembly of a fastening point according to the invention can be simplified in that on the locking head a sliding surface is designed, extending from the upper free front end of the locking head as far as the free, laterally protruding end of the counter-bearing over which the locking section of the spring element slides during its assembly.

Simple, trouble-free assembly is also helped if on the side of the locking head turned away from the bearing recess of the supporting collar, associated with the rail to be fastened, an inclined surface is provided starting from the upper exposed front end of the locking head. This inclined surface can for example be designed so that the holding-down section, possibly with the insulating element supporting it, slides over the inclined surface during assembly, in order to achieve an optimally precise positioning of the holding-down section or the insulating element secured to it. In any event, through the inclined surface the locking head can be designed so that it has sufficient height to securely lock the locking section of the spring element, without in doing so preventing the pivoting of the spring element carried out for assembly.

In order to guarantee precise lateral guidance of the rail over a sufficiently broad area, the system according to the invention can comprise a guide plate, which when the system is fully assembled is arranged between the supporting collar and the foot of the rail to be fastened, so that the rail via the guide plate is laterally supported on the supporting collar. The accurately positioned alignment of the guide plate can be brought about here in that the guide plate comprises a recess, in which when the system is fully assembled the carrier section of the supporting collar sits. In order here to guarantee with minimum effort a secure seating of the guide plate on the supporting collar, the guide plate can also have a bearing recess, which when the system or fastening point is fully assembled is aligned flush with the bearing recess of the supporting collar and when the system is fully assembled together with the bearing recess of the supporting collar forms the pivot bearing for the bearing section of the spring element. In this configuration the bearing section determines the position of the guide plate on the supporting collar, in that it simultaneously engages in the bearing recess of the supporting collar and the bearing recess of the guide plate.

The guidance and retention of the spring element on the carrier section of the supporting collar according to the invention can be further improved in that the carrier section is provided with a stop against which the second curved section rests when the system is fully assembled.

Supporting collars particularly suited to the purposes according to the invention are those made from a cast material, in particular from a steel or iron cast material. Such supporting collars can be produced particularly cheaply in large quantities and also have optimum performance characteristics.

The assembly and disassembly of a fastening point according to the invention can take place with simple means. For assembly all that is needed is a tool with which, in the manner of a handle, the locking section after positioning of the bearing section in the bearing seat of the supporting collar can be pivoted, by twisting the second curved section of the spring, until it comes up against the counter-bearing formed on the locking head of the supporting collar and is retained there. Equally, disassembly of the spring element can take place in that, by means of a suitable lever tool the locking section can be separated from the counter-bearing on the locking head of the supporting collar and the spring element unclamped, so that finally it can be pulled out of the bearing seat of the supporting collar.

In the following the invention is explained in more detail using an exemplary embodiment.

DESCRIPTION OF THE INVENTION

Figure 1:
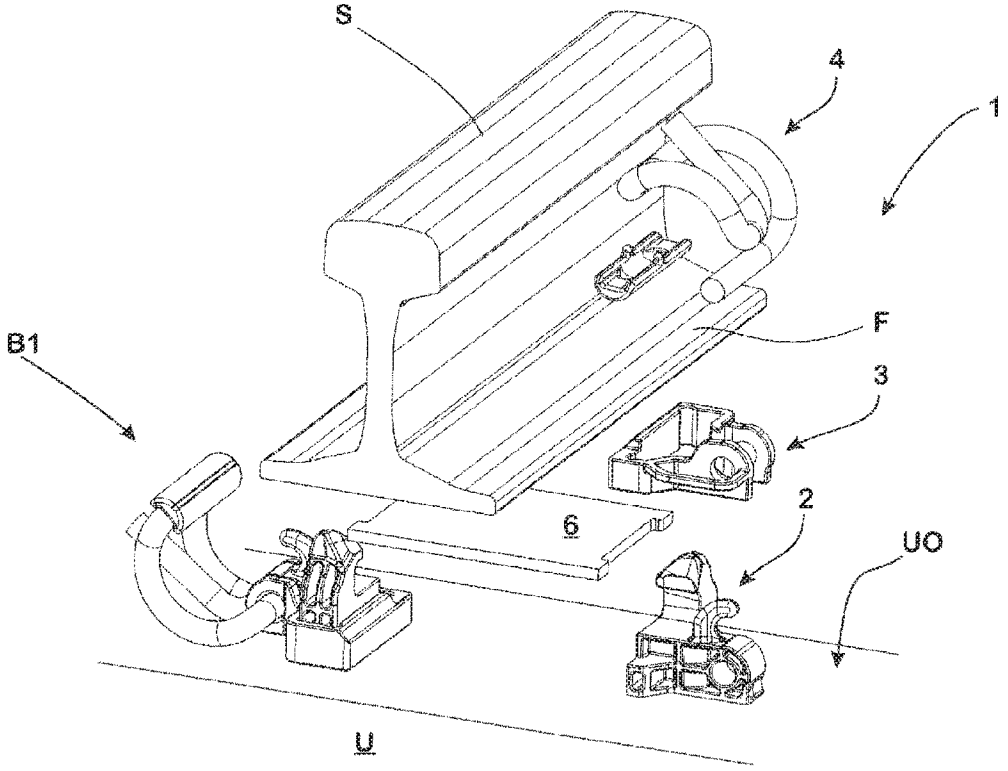
FIG. 1 is a perspective view of a system (right side) and a fastening point constituted by such a system (left side) for the fastening of a rail for a rail vehicle, wherein the system is shown in an exploded view.
Figure 1A:
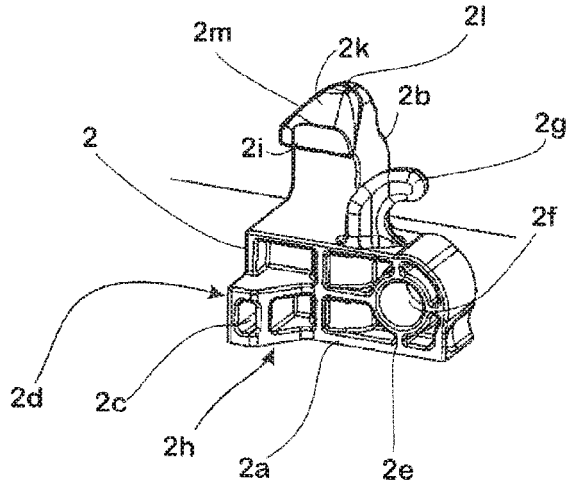
FIG. 1*a* is a perspective view of a supporting collar.
Figure 1B:
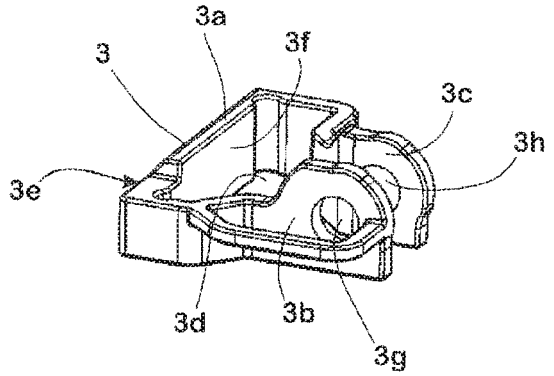
FIG. 1*b* is a perspective view of a guide plate.
Figure 1C:
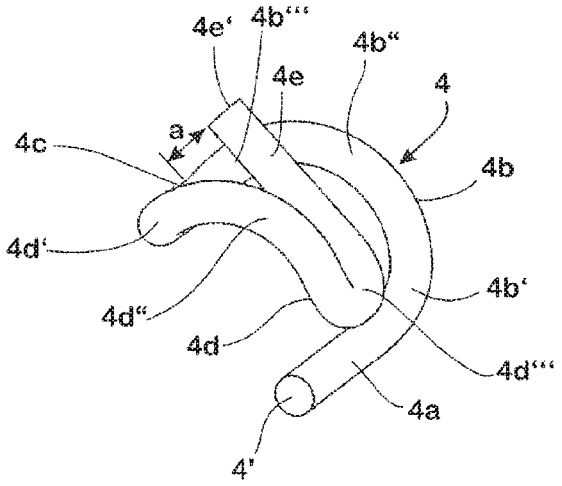
FIG. 1*c* is a perspective view of a spring element.
Figure 3:
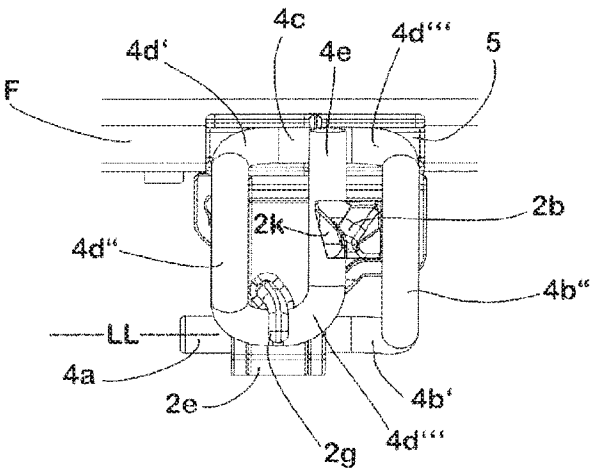
FIG. 3 is a top view of a fastening point of the rail fastening according to FIG. 2.

FIG. 1 shows a rail S, that is to be secured to a foundation U formed here by a sleeper cast in a conventional manner from concrete. The rail S is part of a track for rail vehicles not shown in more detail. The sleeper forming the foundation U sits in a similarly known manner on a gravel bed, which for the sake of clarity is likewise not shown.

The individual parts of a system according to the invention 1 for fastening the rail S are shown in the right half of FIG. 1, whereas in the left half of FIG. 1 a fastening point B1 constituted by such a system 1 is shown in a preassembled state. Two fastening points B1, B2 each composed of a system 1 form a rail fastening SB, by which the rail S on both sides of its rail foot F is secured to the foundation U.

A system 1 according to the invention for the screwless fastening of a rail S in each case comprises a supporting collar 2, a guide plate 3, a spring element 4 and an insulating element 5.

The supporting collar 2 cast in one piece in a cast iron material and taking into consideration conventional rules for the design of such cast parts has a carrier section 2*a*, a fastening section in the form of a blade, not visible here, integrated with the underside of the carrier 2*a* and a locking head 2*b* supported by the carrier section 2*a*, and integrated with its top side. The fastening section of the supporting collar 2 is not visible here, because during the manufacture of the sleeper forming the foundation U, the supporting collar 2 has already been cast with its fastening section into the material of the sleeper, so that the supporting collar 2 has a fixed and non-detachable connection with the foundation U formed by the sleeper and the carrier section 2*a* is supported by its underside on the free top side UO of the foundation U.

In its front section associated with the foot F of the rail S, the carrier section 2*a* has a widening 2*c*, on the front end of which associated with the rail S a flat support surface 2*d* is present. On the rear end section 2*e* of the carrier section 2*a* turned away from the support surface 2*d* however, a bearing recess 2*f* in the form of a circular through opening is formed, the longitudinal axis LL of which extends parallel to the support surface 2*d* and thus when the fastening point B1, B2 is fully assembled in each case extends parallel to the longitudinal extension L of the rail S.

On the top side of the carrier section 2*a*, in the region of the end section 2*e*, a hook-like stop 2*g* opening in the direction of the free end of the end section 2*e* is formed.

The locking head 2*b* with shaft-like form of the supporting collar 2 on the other hand is positioned on the front widening 2*c* of the carrier section 2*a*. At the same time, the locking head 2*b* has on its free head end a projection 2*i* towards a longitudinal side 2*h* of the supporting collar 2, e.g. in the direction of the extension of the longitudinal axis LL of the bearing recess 2*f*, the underside of which associated with the carrier section 2*a* merges into a channel in the lateral surface of the shaft section associated with the locking head 2*b*. On the upper free front end of the locking head 2*b* a sliding surface 2*k* is formed, which starting from the tip 2*l* on the upper free front end of the locking head 2*b* extends as far as the free, laterally prominent end of the projection 2*i* and over which the locking section of the spring element slides when it is assembled. In the same way an inclined surface 2*m* extends from the tip 2*l* in the direction of the front edge of the locking head 2*b* associated with the rail S and the support surface 2*d*.

The guide plate 3 of the system 1 comprises a fibre-reinforced plastic, as normally used in the manufacture of highly loaded plastic components, used in track superstructures. Seen from above, the guide plate 3 has a U-shape with a base section 3*a* and two mirror-symmetrically formed leg sections 3*b*, 3*c* protruding from it at right angles. Together with the leg sections 3*b*, 3*c* the base section 3*a* defines a seat 3*d*, the shape of which is adapted to the outer contour of the carrier section 2*a* of the supporting collar 2. Here the base section 3*a* has a linear design like a narrow web and on its inner side associated with the seat 3*d* and on its outer side associated with the rail S opposite this a flat contact surface 3*e*,3*f*. In each of the free end sections of the leg sections 3*b*,3*c* a bearing recess 3*g*,3*h* in the form of a circular through opening is formed, the longitudinal axes of which extend parallel to the contact surfaces 3*e*,3*f* of the base section 3*a* and the opening diameter of which is the same as the diameter of the bearing recess 2*f* of the carrier section 2*a* of the supporting collar 2.

To assemble the respective fastening point B1, B2 the guide plate 3 is slid over the carrier section 2*a* and aligned so that it sits on the top side UO of the foundation U and in so doing with its base section 3*a* and its leg sections 3*b*,3*c* rests in a form-fitting and sealed manner on the respectively associated lateral surfaces of the carrier section 2*a*. The inner contact surface 3*e* of the base section 3*a* is then supported on the supporting surface 2*d* of the supporting collar 2. Simultaneously the bearing recesses 3*g*,3*h* coincide with the bearing recess 2*f* of the supporting collar 2.

The spring element 4 bent from a conventional spring wire steel has, starting from its one end 4', in succession, a bearing section 4*a*, a first curved section 4*b*, a holding-down section 4*c*, a second curved section 4*d* and a locking section 4*e*.

The bearing section 4*a* has a linear pin-like design with a circular cross-section. Its external diameter corresponds with a slight undersize to the diameter of the bearing recesses 2*f*,3*g*,3*h*, so that the bearing section 4*a* is slid with low play into the bearing recesses 2*f*,3*g*,3*h* and in the bearing recesses 2*f*,3*g*,3*h* is able to pivot about the pivot axis formed by its longitudinal axis LL.

In the spring element 4 resting on the foundation, connected to the bearing section 4*a* is a section 4*b'* of the first curved section 4*b*, bent upwards in a curve of approximately 90° when seen from the side, which merges into an upwardly domed second section 4*b*", which seen from above is aligned at right-angles to the bearing section 4*a* and describes a curve of approximately 180°, which in turn leads into a third section 4*b*'" of the first curved section 4*b*. This third section 4*b*'" is bent so that the linearly-shaped holding-down section 4*c* connected to this section 4*b*'", is aligned axially parallel to the bearing section 4*a*.

The holding-down section 4*c* is shorter than the bearing section 4*a* and merges into a first section 4*d'* of the second curved section 4*d* of the spring element 4. This first section 4*d'* is bent so that the section 4*d*" of the second curved section 4*d*, bent upwards according to section 4*c*" of the first curved section 4*b* and connected to the first section 4*d'*, seen from above is aligned at right-angles to the holding-down section 4*c* in the direction of the bearing section 4*a*. The length of the section 4*d*" is dimensioned here so that above the bearing section 4*a* it merges into a further section 4*d*'" of the second curved section 4*d*, which likewise is arranged further above and at a certain distance to the bearing section 4*a*.

This section 4*d*'" is formed by two 90° curves with a short linear section in between, so that the likewise linearly designed locking section 4*e* of the spring element 4 connected to the section 4*e*, when seen from above is aligned at right-angles to the bearing section 4*a* and the holding-down section 4*c*. Here the free end 4*e'* of the locking section 4*e* points in the direction of the holding-down section 4*c* and in the unclamped state is arranged at a distance from this. At the same time, the length of the locking section 4*e* is dimensioned so that the free end 4*e'* of the locking section 4*e* when seen from above projects beyond the holding-down section 4*c*.

Figure 2:
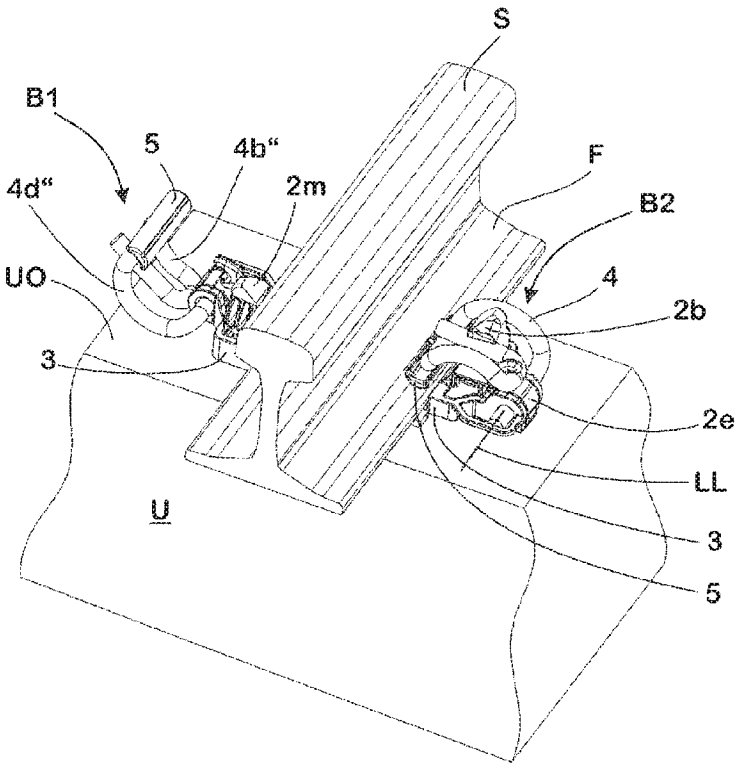
FIG. 2 is a perspective top view corresponding to FIG. 1 of a rail fastening with two fastening points.
Figure 4B:
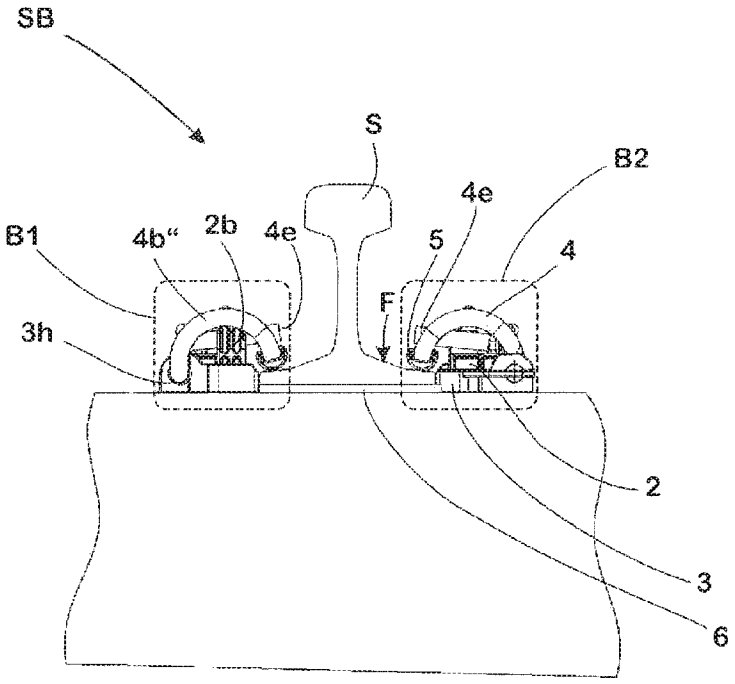
FIG. 4*b* is the rail fastening according to FIG. 2 in the fully assembled state.
Figure 4A:
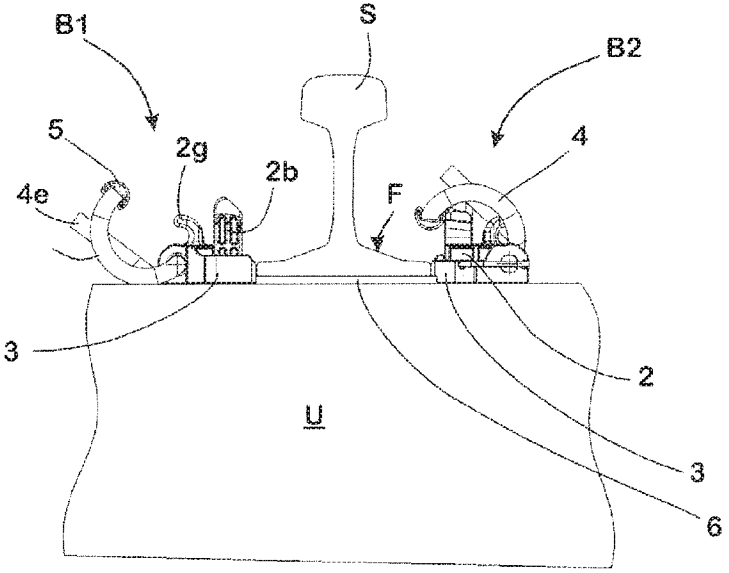
FIG. 4*a* is a side view of the rail fastening according to FIG. 2 with its two fastening points each in different stages of assembly.
Figure 5B:
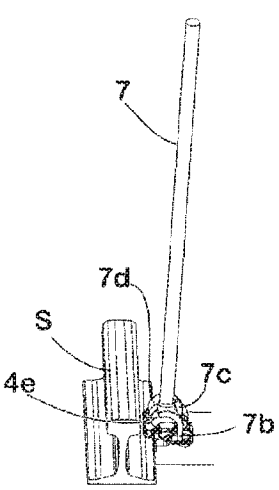
FIG. 5*b* is a perspective view of the tool according to FIG. 5*a* in a working position.
Figure 5A:
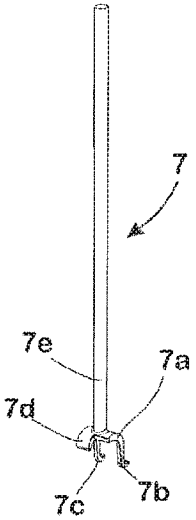
FIG. 5*a* is a perspective view of a tool for assembling the fastening points.
Figure 7:
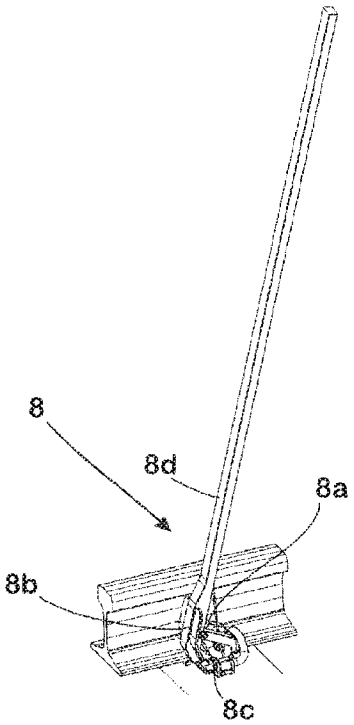
FIG. 7 is a perspective view of a tool for disassembling the fastening points.
Figure 6:
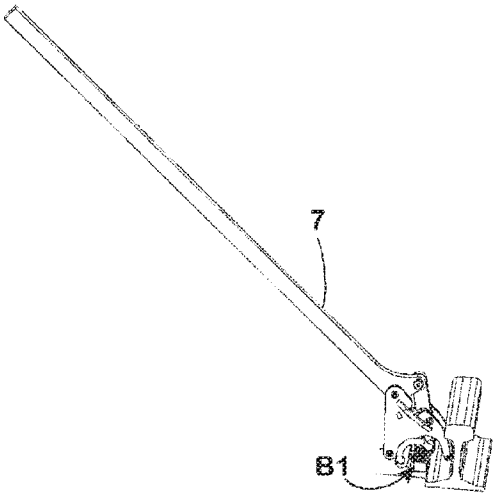
FIG. 6 is a perspective view of an alternative configuration of a tool for assembling the fastening points.

Here the locking section 4*e* is aligned so that between it and the holding-down section 4*c* at least with the unassembled, unclamped spring element 4 seen from the side (FIG. 2, left half) a distance a exists between the locking section 4*e* and the holding-down section 4*c*.

The insulating element 5 is manufactured from an electrically non-conducting plastic and has the basic form of a half shell. Here it is designed so that in a known manner it can be secured by means of a clip connection to the holding-down section 4*c* of the spring element 4.

Following the manufacture of the sleeper forming the foundation U the fastening points B1, B2—possibly while still in the factory of the sleeper manufacturer—can be preassembled from two systems 1. To this end, in each case an insulating element 5 is secured to the spring element 4 and in each case a guide plate 3 is positioned in the manner described above on the top side UO of the foundation U, so that the carrier section 2*a* of the respective supporting collar 2 sits in the seat 3*d* of the respective guide plate 3. Then in each case a spring element 4 with its bearing section 4*a* is pushed through the now flush aligned bearing recesses 2*f*,3*g*,3*h*, wherein the spring element 4 to this end, as shown in FIG. 1, 2, 4, in each case in the left half, is brought into a position pivoted away from the rail S to be fastened, in which the spring element 4 on sections 4*b*" and 4*d*" of its curved sections 4*b*,4*d* is supported on the top side UO. Here the length of the bearing section 4*a* of the spring element 4 is dimensioned so that in each case an end section of the bearing section 4*a* extends laterally beyond the width included by the leg sections 3*b*,3*c* of the guide plate 3 and the end section 2*e* of the carrier section 2*a* in the region of its bearing recesses 2*f*,3*g*,3*h*.

The height above the top side UO adopted by the spring elements 4 in this pivot position is greater than the height of the locking head 2*b*, so that in the event of a plurality of sleepers having to be stacked one on top of the other for transport, in each case the sleeper arranged below is supported on the spring elements 4 and not on the locking heads 2*b*. The comparatively vulnerable locking heads 2*b* are thus protected from damage.

To fully fasten the rail S between the fastening points B1, B2 on the foundation UO a plate 6 is positioned, made from an elastic material and guaranteeing in a known manner a defined flexibility, directed towards gravity in the contact area of the rail S. Then the rail S is positioned and the respective spring element 4 pivoted in the direction of the rail S. Here the inclined surface 2*m* allows a collision-free movement of the spring element 4 even if the insulating element 5 is pre-assembled on its holding-down section 4*c*.

Now the spring elements 4 are clamped by means of the clamping tool 7. To this end the clamping tool 7 has a claw 7*a* with prongs 7*b*,7*c*, bent outwards so that when the clamping tool 7 is applied to the spring element 4, from the side associated with the holding-down section 4*c* they engage below the end sections of the bearing section 4*a* of the spring element 4 projecting beyond the external lateral surfaces of the leg sections 3*b*,3*c*.

On its side turned away from the claw 7*a*, the clamping tool 7 has a nose 7*d*, which is formed and arranged so that when the prongs 7*b*,7*c* are applied to the bearing section 4*a* it sits on the free end section of the locking section 4*e*. By pivoting by means of a handle 7*e* provided on the clamping tool 7 about the axis formed through the bearing section 4*a* the locking section 4*e* is now pivoted through corresponding deformation in particular of the second curved section 4*d*, so that it is moved along the sliding surface 2*k* and slides past the projection 2*i*, until it hooks onto the underside of the projection 2*i* of the locking head 2*b* and is securely held there in a latched position.

At the same time the locking head 2*b* which when the spring element 4 is fully assembled sits in the interstice delimited by the locking section 4*e*, the second curved section 4*d* and section of the holding-down section 4*c* provides a guide, via which the spring element 4 is secured in the longitudinal and transversal direction of the rail S. Here the locking section 4*e* which when the spring element 4 is fully assembled projects over the holding-down section 4*c* forms a stop, which in the manner of tilting protection ensures that the rail S, even under unfavourable conditions, does not lift too far from the foundation U under the load of a rail vehicle passing over the rail fastening SB. If necessary the clamping tool 7 can of course be designed as a handle mechanism or similar, in order to be able to apply greater deforming forces when pivoting the locking section 4*e* into its position of use.

The position of the second curved section 4*d* of the spring element 4 when the system 1 is fully assembled is secured by the stop 2*g*, against which the second curved section 4*d* is retained so that even under the high loads of the spring element 4 occurring in use this sits securely on the supporting collar 2.

For disassembly a further tool 8 is used, which similarly has a claw 8*a* with prongs 8*b*,8*c*. The claw 8*a* is secured on a supporting body 8*b* of the tool 8 so that it can pivot and is designed so that it can engage with its prongs the end sections of the locking section 4*e* projecting over the projection 2*i* of the locking head 2*b*. Here the supporting body 8*b* has a nose 8*c*, via which the tool 8, when the claw 8*a* is coupled with the locking section 4*e*, is laterally supported on the associated leg section 3*b* of the guide plate 3 and on the foundation U. By pivoting the tool B about the pivot axis formed through the support point of the nose 8*c* by means of a handle 8*d* secured to the supporting body 8*b* the locking section 4*e* is extracted laterally from its latched position below the projection 2*i*, until it can freely pivot upwards and the spring element 4 is unclamped.

The assembly and disassembly process has been described above for the use of hand tools. The corresponding procedure can of course also be performed by automation.

REFERENCE NUMERALS

1 System for screwless fastening of a rail S
2 Supporting collar
2*a* Carrier section
2*b* Locking head
2*c* Widening
2*d* Support surface
2*e* Rear end section
2*f* Bearing recess
2*g* Stop
2*h* Longitudinal side of supporting collar 2*a*
2*i* Projection (counter-bearing)
2*k* Sliding surface
2*l* Tip of locking head 2*b*
2*m* Inclined surface
3 Guide plate
3*a* Base section
3*b*, 3*c* Leg sections
3*d* Seat
3*e*, 3*f* Contact surface
3*g*, 3*h* Bearing recess
4 Spring element
4' One end of the spring element 4
4*a* Bearing section
4*b* First curved section
4*c* Holding-down section
4*d* Second curved section
4*e* Locking section
4*b*', 4*b*", 4*b*'" Sections of the first curve section 4*b*
4*d*', 4*d*", 4*d*'" Sections of the second curve section 4*d*
4*e*' Free end of the locking section 4*e* (other end of the spring element 4)
5 Insulating element
6 Elastic plate
7 Clamping tool
7*a* Claw
7*b*, 7*c* Prongs
7*d* Nose
7*e* Handle
8 Disassembly tool
8*a* Claw
8*b* Supporting body
8*c* Nose
8*d* Handle
a Distance
B1, B2 Fastening points
F Rail foot
LL Longitudinal axis (pivot axis) of the bearing recess 2*f*
S Rail
SB Rail fastening
U Foundation (concrete sleeper)
UO Top side of foundation U

The invention claimed is:

1. A system for screwless fastening of a rail for a rail vehicle on a foundation comprising:
a spring element
and
a supporting collar,
wherein
the spring element
is bent from a spring wire and
starting from one end of the spring element successively comprises:
a bearing section,
a first curved section, connected to the bearing section,
a holding-down section, connected to the first curved section and aligned in the opposite direction to the bearing section, wherein the holding-down section is configured to rest on an upper surface of a foot of the rail to be fastened,
a second curved section, connected to the holding-down section and curved in the direction of the bearing section
and
a locking section, connected to the second curved section and aligned transversally to the bearing section, wherein at least when the spring element is unassembled seen from the side there is a distance between the holding-down section and the locking section, and wherein the supporting collard comprises:

a fastening section, via which the supporting collar is secured to the foundation, a carrier section supported by the fastening section, a bearing recess formed on the carrier section, in which the bearing section of the spring element is pivot-mounted, and a locking head supported by the carrier section, on which a counter-bearing for the locking section of the spring element is formed such that when the system is fully assembled the locking section is held in a position relative to the bearing section of the spring element in which the spring element is clamped in a springy elastic manner between the bearing recess and the counter-bearing of the supporting collar and the holding-down section acts in a springy elastic manner on the surface of the rail foot associated with the holding-down section.

2. The system according to claim 1, wherein the counter-bearing on the locking head of the supporting collar is a latching projection, protruding from the locking head in a direction aligned parallel to a pivot axis.

3. The system according to claim 2, wherein the locking head comprises a sliding surface extending from an upper free front end of the locking head to a free, laterally protruding end of the counter-bearing and over which the locking section of the spring element is configured to slide.

4. The system according to claim 1, wherein a side of the locking head turned away from the bearing recess of the supporting collar comprises an inclined surface extending from an upper free front end of the locking head.

5. The system according to claim 1, further comprising an insulating element comprising an electrically non-conducting material secured to the holding-down section of the spring element so that the insulating element pivots with the spring element about a pivot axis of the bearing seat of the supporting collar, until the insulating element is positioned between an associated top side of the foot of the rail and the holding-down section of the spring element.

6. The system according to claim 1, further comprising a guide plate configured to be arranged between the supporting collar and the foot of the rail to be fastened so that the rail is supported laterally via the guide plate on the supporting collar.

7. The system according to claim 6, wherein the guide plate comprises a recess in which the carrier section of the supporting collar is configured to sit.

8. The system according to claim 7, wherein the guide plate comprises a bearing recess configured to be aligned flush with the bearing recess of the supporting collar such that the bearing recess of the guide plate and the bearing recess of the supporting collar form a pivot bearing for the bearing section of the spring element.

9. The system according to claim 1, wherein at least sections of at least one of the bearing section, the holding-down section, and the locking section of the spring element are linear.

10. The system according to claim 9, wherein when the spring element is seen from above, the bearing section and holding-down section of the spring element are aligned axially parallel to one another and the locking sections are at right angles to the bearing section and the holding-down section.

11. The system according to claim 1, wherein when the spring element is seen from above the locking section projects over the holding-down section of the spring element.

12. The system according to claim 1, wherein the carrier section of the supporting collar comprises a stop, against which the second curved section is configured to rest.

13. The system according to claim 1, wherein the supporting collar comprises a cast metal.

14. A fastening point for a screwless fastening of a rail for rail vehicles wherein the fastening point comprises the system according to claim 1.

15. The fastening point according to claim 14, wherein the foundation is formed by a slab or a sleeper cast in a concrete material and in which the fastening section of the supporting collar is cast.

* * * * *